US007609213B2

(12) United States Patent
Wong et al.

(10) Patent No.: US 7,609,213 B2
(45) Date of Patent: Oct. 27, 2009

(54) TWO-BRANCH BROADBAND ANTENNA

(75) Inventors: Kin-Lu Wong, Kao-Hsiung (TW); Yu-Chan Yang, Taipei (TW); Wei-Yu Li, Yilan County (TW); Saou-Wen Su, Taipei (TW); Jui-Hung Chou, Tai-Chung (TW)

(73) Assignees: Lite-On Technology Corp., Taipei (TW); National Sun Yat-Sen University, Kao-Hsiung (TW)

( * ) Notice: Subject to any disclaimer, the term of this patent is extended or adjusted under 35 U.S.C. 154(b) by 92 days.

(21) Appl. No.: 11/830,855

(22) Filed: Jul. 31, 2007

(65) Prior Publication Data

US 2009/0033584 A1 Feb. 5, 2009

(51) Int. Cl.

| | |
|---|---|
| ***H01Q 1/24*** | (2006.01) |
| ***H01Q 11/12*** | (2006.01) |
| ***H01Q 7/00*** | (2006.01) |
| ***H01Q 9/26*** | (2006.01) |
| ***H01Q 9/38*** | (2006.01) |
| ***H01Q 1/48*** | (2006.01) |

(52) U.S. Cl. ..... 343/702; 343/846; 343/847; 343/829; 343/803; 343/842; 343/741; 343/744; 343/748

(58) Field of Classification Search ..... 343/702, 343/700 MS, 846, 847, 829, 803, 842, 741, 343/744, 748

See application file for complete search history.

(56) References Cited

U.S. PATENT DOCUMENTS

| | | | | |
|---|---|---|---|---|
| 6,870,506 | B2 * | 3/2005 | Chen et al. | 343/700 MS |
| 6,963,310 | B2 * | 11/2005 | Horita et al. | 343/702 |
| 7,034,754 | B2 * | 4/2006 | Hung et al. | 343/700 MS |
| 7,253,775 | B2 * | 8/2007 | Qi et al. | 343/702 |
| 2007/0132646 | A1 * | 6/2007 | Hung et al. | 343/700 MS |

FOREIGN PATENT DOCUMENTS

| | | |
|---|---|---|
| TW | D105579 | 7/2005 |
| TW | M269583 | 7/2005 |

* cited by examiner

*Primary Examiner*—Douglas W Owens
*Assistant Examiner*—Jennifer F Hu
(74) *Attorney, Agent, or Firm*—Kile Goekjian Reed & McManus PLLC

(57) ABSTRACT

A broadband antenna is capable of generating an upper resonant mode (at about 700 MHz) from a first radiating arm and a lower resonant mode (at about 500 MHz) from a second radiating arm. The first and second radiating arms are bent at least one time. An open end of the second radiating arm is extended toward an open end of the first radiating arm with a predefined distance there between. The predefined distance can be adjusted to improve the impedance matching of lower resonant mode, which can be further combined with the upper resonant mode to achieve a broad bandwidth covering the complete spectrum of digital TV channels (470-862 MHz).

6 Claims, 7 Drawing Sheets

TWO-BRANCH BROADBAND ANTENNA

BACKGROUND OF THE INVENTION

1. Field of the Invention

The present invention relates to a broadband antenna, and more particularly, to a two-branch broadband antenna fit for a portable multimedia player.

2. Description of the Prior Art

TV has played an important role in allowing people to receive the news and the entertainment information. Along with the wireless communication development, TV programs were traditionally transmitted through analog signals, and presented the image with an analog TV. The analog signal is easily interfered with by noise in the transmission process so as to reduce the clarity and the stability of the image.

In the contrast, the TV program transmitted through the digital signals presents the image of better quality. Moreover, the digital signal is stable and can provide further multimedia services. Thus, the inevitable tendency is that the digital TV system will replace the analog TV system. The range of foreseeable portable multimedia products with a digital TV function will have a big market opportunity. To reach this goal, how to design an antenna with a simple structure and a thin shape, which can be integrated easily into the portable digital TV device, is a big problem to be solved.

The R.O.C. patent number M269583 "DIGITAL TV ANTENNA" shows a digital TV antenna, but the structure of the antenna is complicated so that the antenna has high cost and narrow bandwidth. The R.O.C. patent number D105579 "DIGITAL TV ANTENNA" shows a digital TV antenna, which can receive the digital signals in practice, but the size of the antenna is large so that the antenna is not suitable for general portable products. To solve the mentioned problems, a new digital antenna, which can generate a broad bandwidth covering the complete spectrum of digital TV channels (470-862 MHz) and has a simple structure so as to fit the portable TVs or multimedia players, should be provided.

SUMMARY OF THE INVENTION

It is therefore an objective of the claimed invention to provide a two-branch broadband antenna capable of generating an upper resonant mode (at about 700 MHz) from a first radiating arm and a lower resonant mode (at about 500 MHz) from a second radiating arm. The first and second radiating arms are bent at least one time. An open end of the second radiating arm is extended toward an open end of the first radiating arm with a predefined distance there between. The predefined distance can be adjusted to improve the impedance matching of the lower resonant mode, which can be further combined with the upper resonant mode to achieve a broad bandwidth covering the complete spectrum of digital TV channels (470-862 MHz).

The claimed invention provides a two-branch broadband antenna comprising a ground plane and a radiating portion. The radiating portion is substantially a planar structure and comprises a first radiating arm and a second radiating arm. The first radiating arm, bent at least one time, has a closed end and an open end. The closed end located near an edge of the ground plane is a feeding portion of the antenna, and the open end is extended toward a centerline of the radiating portion. The second radiating arm, bent at least one time, has a closed end and an open end. The closed end is electrically connected near the closed end of the first radiating arm, and the open end is extended toward the open end of the first radiating arm with a predefined distance there between.

These and other objectives of the present invention will no doubt become obvious to those of ordinary skill in the art after reading the following detailed description of the preferred embodiment that is illustrated in the various figures and drawings.

DETAILED DESCRIPTION

Figure 1:
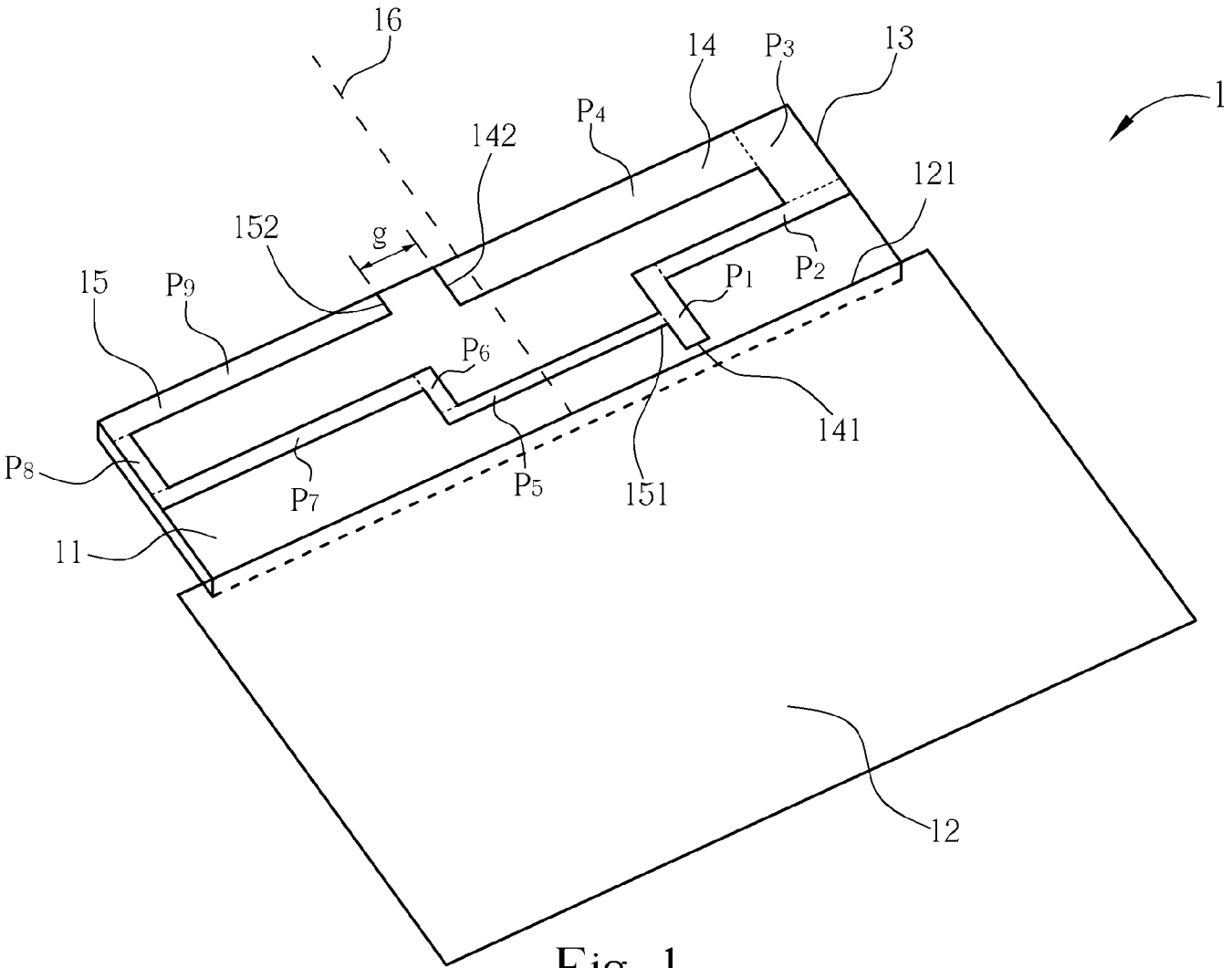
FIG. 1 is a first embodiment of a two-branch broadband antenna according to the present invention.

Please refer to FIG. 1. FIG. 1 is a first embodiment of a two-branch broadband antenna according to the present invention. The two-branch broadband antenna 1 comprises a ground plane 12 and a radiating portion 13. The radiating portion 13 is substantially a planar structure. The radiating portion 13 comprises a first radiating arm 14 and a second radiating arm 15. The radiating portion 13 is not connected to the ground plane 12. The first radiating arm 14 forms a first U shape, the second radiating arm 15 forms a second U shape, and the opening of the second U shape is opposite to the opening of the first U shape. The first radiating arm 14 comprises four parts $P_1$, $P_2$, $P_3$, and $P_4$. The part $P_1$ has a closed end 141 located near an edge of the ground plane 12, which is a feeding portion of the antenna 1. The part $P_2$ is extended from the part $P_1$ and is perpendicular to the part $P_1$. The part $P_2$ is extended from the part $P_2$ and is parallel to the part $P_1$. The part $P_4$ is extended from the part $P_3$ and is perpendicular to the part $P_1$, and has an open end 142. The second radiating arm 15 comprises five parts $P_5$, $P_6$, $P_7$, $P_8$, and $P_9$. The part $P_5$ is perpendicular to the part $P_1$ and has a closed end 151 connected to the part $P_1$. The part $P_6$ is extended from the part $P_5$ and is parallel to the part $P_1$. The part $P_7$ is extended from the part $P_6$ and is perpendicular to the part $P_1$. The part $P_8$ is extended from the part $P_7$, and is parallel to the part $P_1$. The part $P_2$ is extended from the part $P_8$ and is perpendicular to the part $P_1$, and has an open end 152 extended toward the open end 142 of the part $P_4$ with a predefined distance g. The predefined distance g is generally smaller than 25 mm. The radiating portion 13 can be formed by printing or etching on the substrate 11. Also, the radiating portion 13 can be formed by stamping or cutting a sheet of metal and fixed on the substrate 11. In this embodiment, the ground plane 12 is a system ground plane of a portable multimedia player.

Figure 2:
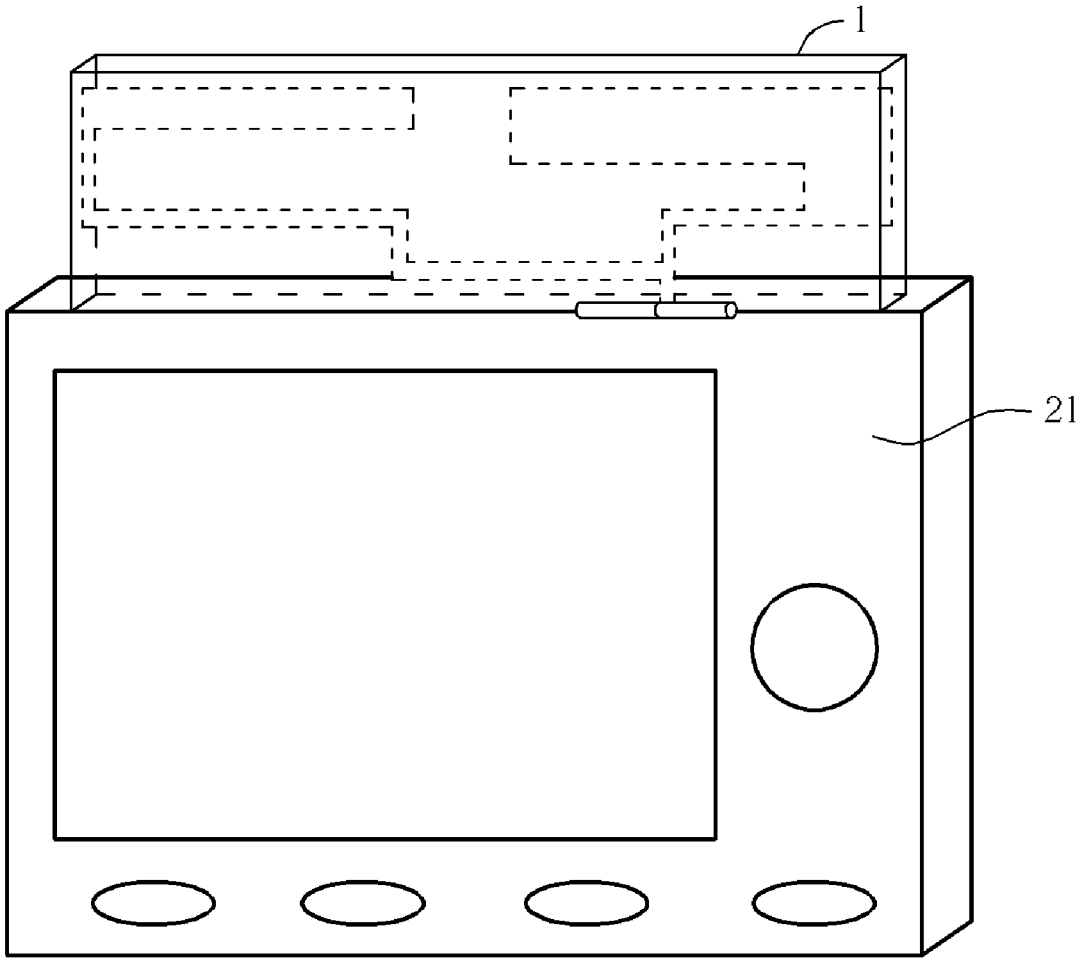
FIG. 2 is a portable multimedia player using a two-branch broadband antenna according to the present invention.

Please refer to FIG. 2. FIG. 2 is a portable multimedia player using a two-branch broadband antenna according to the present invention. The two-branch broadband antenna 1 is substantially a planar structure, so the antenna 1 can be folded and located onto the LCD panel of the portable multimedia player 21. Thus, the antenna 1 is easy to pack and keeps the clear profile of the portable multimedia player 21.

Figure 3:
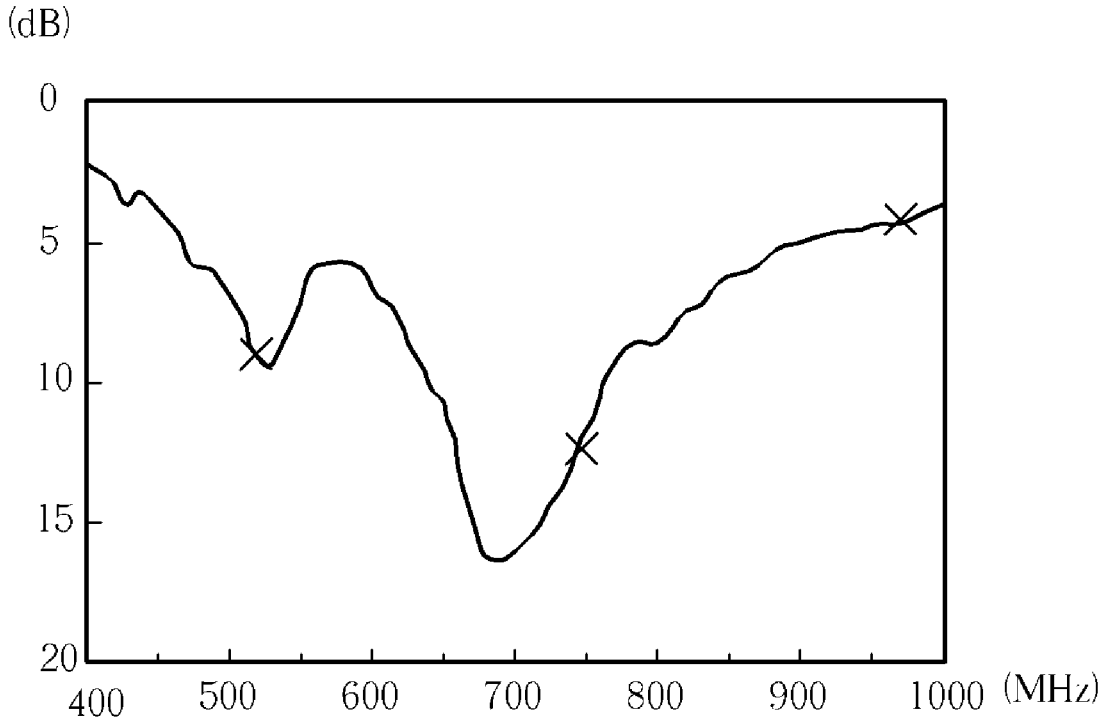
FIG. 3 is the return loss of the two-branch broadband antenna according to the present invention.

Please refer to FIG. 3. FIG. 3 is the return loss of the two-branch broadband antenna according to the present invention. In this embodiment, the sizes of the two-branch broadband antenna 1 are as follows. The ground plane 12 is 130 mm in length and 80 mm in width. The radiating portion 13 is substantially a 130 mm×35 mm planar structure. The widths of the closed end 141 and open end 142 of the first radiating arm 14 are 3 mm and 12 mm, respectively. The distance between the closed end 141 and open end 142 is about 107 mm, which is about 0.25 times of the center frequency of about 700 MHz. The widths of the closed end 151 and open end 152 of the second radiating arm 15 are 2 mm and 7 mm, respectively. The distance between the closed end 151 and open end 152 is about 150 mm, which is about 0.25 times of the center frequency of about 500 MHz. The predefined distance g of the open end 142 of the first radiating arm 14 and the open end 152 of the second radiating arm 15 is 15 mm. As shown in FIG. 3, the y-coordinate axis is return loss, and the x-coordinate axis is frequency. From the data, the return loss of the antenna 1 in the spectrum of digital TV channels 470-862 MHz is higher than 5 dB. Thus, the return loss of the antenna 1 can satisfy the requirements of the digital TV system in practice.

Figure 4:
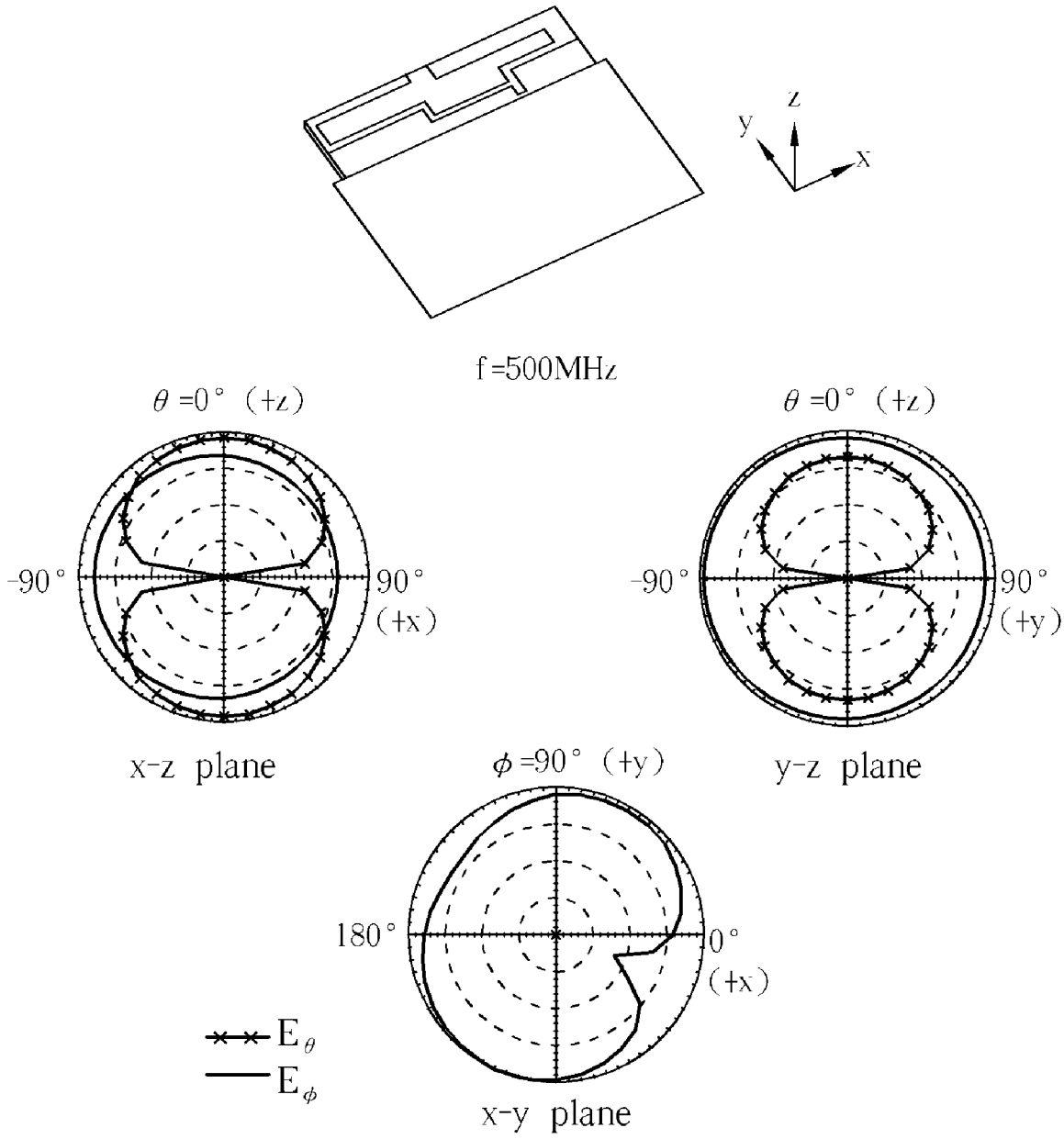
FIG. 4 is the radiation pattern at 500 MHz of the two-branch broadband antenna according to the present invention.
Figure 5:
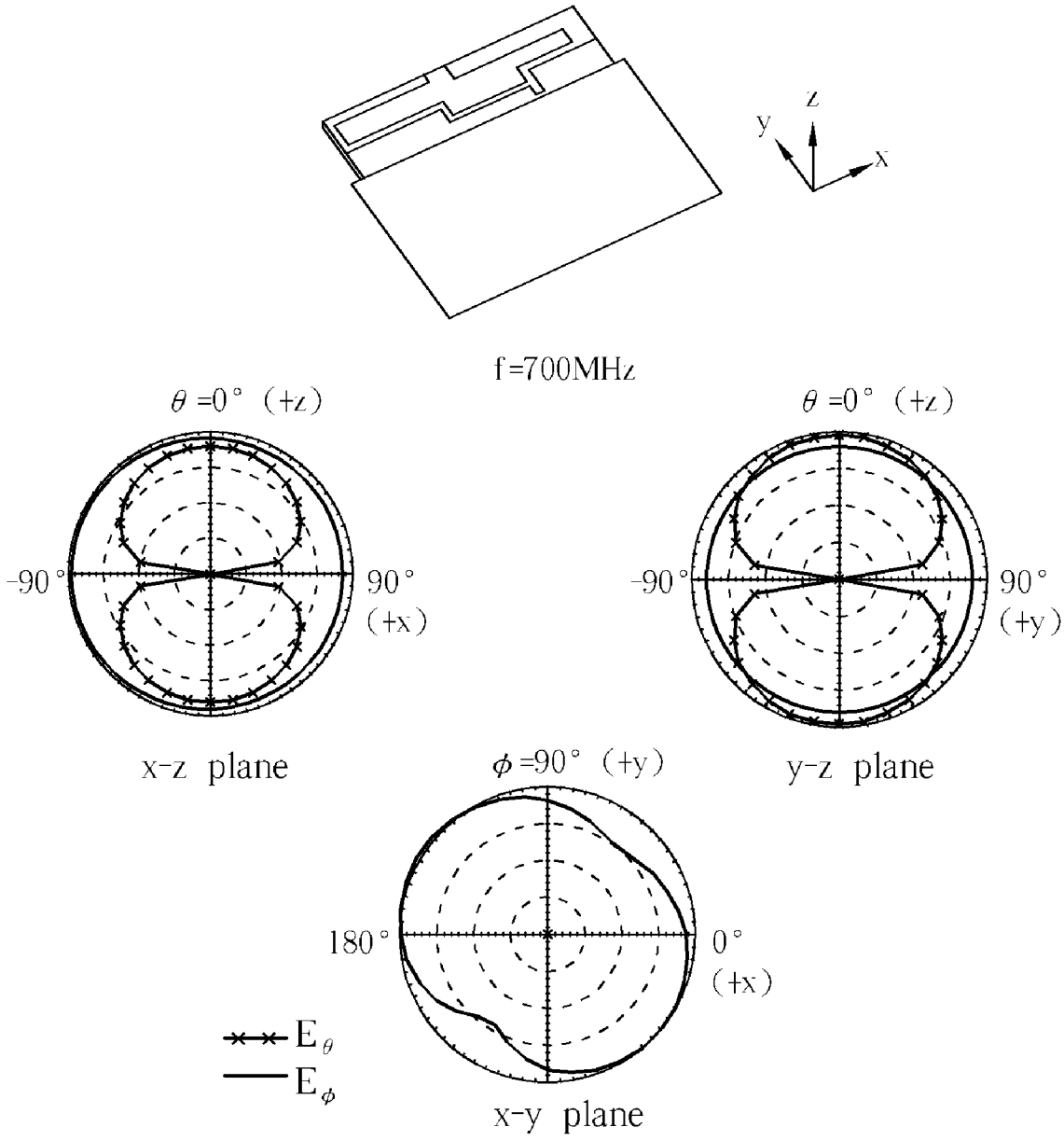
FIG. 5 is the radiation pattern at 700 MHz of the two-branch broadband antenna according to the present invention.

Please refer to FIG. 4 and FIG. 5. FIG. 4 shows the radiation pattern at 500 MHz of the two-branch broadband antenna according to the present invention. FIG. 5 shows the radiation pattern at 700 MHz of the two-branch broadband antenna 1 according to the present invention. From the measurement result, the antenna 1 has an omnidirectional radiation field on x-y plane (horizontal plane) so as to satisfy the operational requirements of the digital TV antenna.

Figure 6:
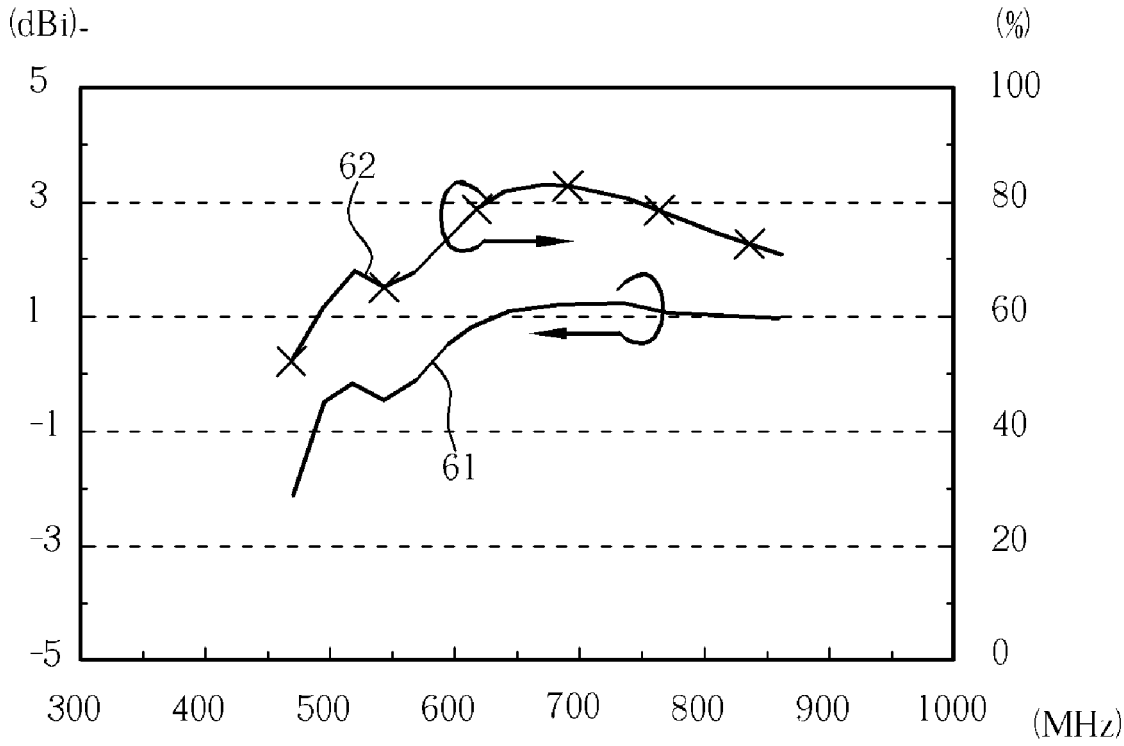
FIG. 6 shows the antenna gain and the radiation efficiency in the operational bandwidth of the two-branch broadband antenna according to the present invention.

Please refer to FIG. 6. FIG. 6 presents the antenna gain 61 and the radiation efficiency 62 in the operational bandwidth of the two-branch broadband antenna 1 according to the present invention. As shown in FIG. 6, the right y-coordinate axis is radiation efficiency; the left y-coordinate axis is antenna gain; the x-coordinate axis is frequency. From the measurement result, in the bandwidth 470-862 MHz, the radiation efficiency 62 of the antenna 1 is higher than 50%, and the antenna gain 61 of the antenna 1 is larger than −2 dBi. Thus, the antenna 1 can satisfy the general requirements in practice.

Figure 7:
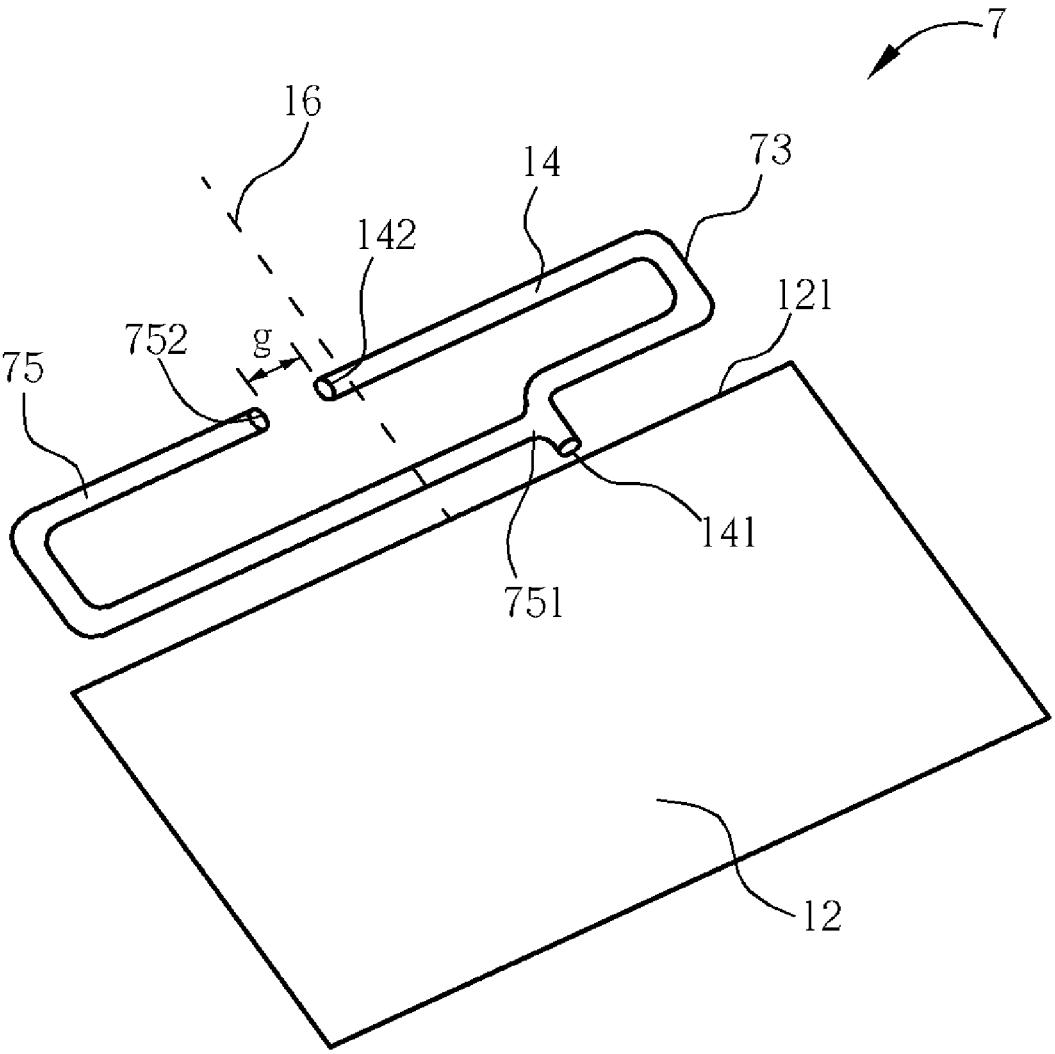
FIG. 7 is a second embodiment of a two-branch broadband antenna according to the present invention.

Please refer to FIG. 7. FIG. 7 is a second embodiment of a two-branch broadband antenna according to the present invention. In the second embodiment, the two-branch broadband antenna 7 comprises a radiating portion 73 bent by a metal wire. In addition, the second radiating arm 75 in the second embodiment is bent fewer times than the second radiating arm 15 in the first embodiment. Similarly, the two-branch broadband antenna 7 can satisfy the requirements of bandwidth and radiation efficiency of the digital TV system.

In conclusion, the two-branch broadband antenna according to the present invention is capable of generating an upper resonant mode (at about 700 MHz) from a first radiating arm and a lower resonant mode (at about 500 MHz) from a second radiating arm. The first and second radiating arms are bent at least one time. An open end of the second radiating arm is extended toward an open end of the first radiating arm with a predefined distance there between. The predefined distance can be adjusted to improve the impedance matching of lower resonant mode, which can be further combined with the upper resonant mode to achieve a broad bandwidth covering the complete spectrum of digital TV channels (470-862 MHz). In addition, the antenna according to the present invention has a simple structure so as to fit the portable TVs or multimedia players.

Those skilled in the art will readily observe that numerous modifications and alterations of the device and method may be made while retaining the teachings of the invention.

What is claimed is:

1. A two-branch broadband antenna comprising:

a ground plane; and a radiating portion, which is substantially a planar structure, comprising:

a first radiating arm with length of 0.25 times of a first center frequency about 700 MHz, being a first U shape, the first radiating arm comprising:

a first part having a closed end located near an edge of the ground plane, which is a feeding portion of the antenna;

a second part extended from the first part and perpendicular to the first part;

a third part extended from the second part and parallel to the first part; and a fourth part extended from the third part and perpendicular to the first part and having an open end; and a second radiating arm with length of 0.25 times of a second center frequency about 500 MHz being a second U shape, opening of the second U shape being opposite to opening of the first U shape, the second radiating arm comprising:

a fifth part perpendicular to the first part and having a closed end connected to the first part a sixth part extended from the fifth part and parallel to the first part;

a seventh part extended from the sixth part and perpendicular to the first part;

an eighth part extended from the seventh part and parallel to the first part; and a ninth part extended from the eighth part and perpendicular to the first part and having an open end extended toward the open end of the fourth part with a predefined distance;

wherein the radiating portion is not connected to the ground plane.

2. The two-branch broadband antenna of claim 1, wherein the radiating portion is formed by printing or etching on a substrate.

3. The two-branch broadband antenna of claim 1, wherein the radiating portion is formed by stamping or cutting a sheet of metal.

4. The two-branch broadband antenna of claim 1, wherein the predefined distance between the open end of the fourth part and the open end of the ninth part is smaller than 25 mm.

5. The two-branch broadband antenna of claim 1, wherein the ground plane is a system ground plane of a portable multimedia player.

6. The two-branch broadband antenna of claim 1, wherein the radiating portion is bent by a metal wire.

* * * * *